US011654542B2

(12) United States Patent
Li

(10) Patent No.: US 11,654,542 B2
(45) Date of Patent: May 23, 2023

(54) PNEUMATIC TOOL WITH FORWARD AND REVERSE ROTATION CONTROL STRUCTURE

(71) Applicant: BASSO INDUSTRY CORP., Taichung (TW)

(72) Inventor: Chin-Cheng Li, Taichung (TW)

(73) Assignee: BASSO INDUSTRY CORP., Taichung (TW)

( * ) Notice: Subject to any disclaimer, the term of this patent is extended or adjusted under 35 U.S.C. 154(b) by 182 days.

(21) Appl. No.: 16/860,525

(22) Filed: Apr. 28, 2020

(65) Prior Publication Data

US 2020/0346336 A1 Nov. 5, 2020

(30) Foreign Application Priority Data

May 3, 2019 (TW) ..... 108205513

(51) Int. Cl.
*B25F 5/00* (2006.01)
*B25F 5/02* (2006.01)

(52) U.S. Cl.
CPC ..... *B25F 5/001* (2013.01); *B25F 5/02* (2013.01)

(58) Field of Classification Search
CPC . B25B 23/16; B25B 21/00; B25F 5/00; B25F 5/02; B25F 5/001; B25F 5/005; F16K 31/44; F16K 31/54; Y10T 137/86839
See application file for complete search history.

(56) References Cited

U.S. PATENT DOCUMENTS 5,199,460 A * 4/1993 Geiger ..... F16K 31/54 137/625.43
2003/0075348 A1* 4/2003 Eardley ..... B25F 5/00 173/169
2013/0186665 A1* 7/2013 Hua ..... B25F 5/02 173/170

* cited by examiner

*Primary Examiner* — Daniel Jeremy Leeds
(74) *Attorney, Agent, or Firm* — Chun-Ming Shih; HDLS IPR Services

(57) ABSTRACT

A pneumatic tool with a forward and reverse rotation structure includes a housing, a retaining member, two push buttons and a positioning pin. The housing includes an installation space. The retaining member is arranged inside the installation space to divide it into two push button accommodating cavities. The two push buttons movably slide inside the two push button accommodating cavities. The retaining member restricts the sliding ranges of the two push buttons. The positioning pin penetrates into the housing to allow the retaining member to be secured by the housing and the positioning pin. Accordingly, the retaining member is secured firmly while allowing it be removed for replacement and repair, the positioning pin is prevented from slippage, and any slipping off or snapping off of components between the sliding block of the push button and the slot wall of the retaining member can also be prevented.

14 Claims, 10 Drawing Sheets

PNEUMATIC TOOL WITH FORWARD AND REVERSE ROTATION CONTROL STRUCTURE

BACKGROUND OF THE INVENTION

Field of the Invention

The technical field relates to a pneumatic tool, in particular, to a pneumatic tool with a forward and reveres rotation control structure.

Description of Related Art

For a pneumatic tool, to control the forward and reverse rotations of such pneumatic tool, it is necessary to provide a forward and reverse rotation control structure in order to control the forward and reverse rotations of the power unit.

Presently, a forward and reverse control structure cannot be manufactured via molding formation process directly such that there is a need to install a push button retaining piece additionally. Currently, most of the push button retainer plates adopt the permanent bonding method with the use of adhesive gel or the screw fastening method for securement. When an adhesive gel is used for permanent bonding, the drawback would be that the retaining piece cannot be subsequently removed for replacement or repair. In addition, if screws are used for fastening, then there are drawbacks of damaged threads and unpleasant appearance due to the exposure of the screw heads.

Moreover, it is also known that the structure of hook is used between a push button and a push button retainer plate to achieve the retention therebetween. Nevertheless, since the structure of hook tends to slip off or snap off, such drawback also causes inconvenience to users during the use thereof.

SUMMARY OF THE INVENTION

In one aspect, the present invention is to provide a pneumatic tool with a forward and reverse rotation control structure, capable of using a positioning pin to penetrate into a housing, and a retaining member is secured between the housing and a fixation pin. Consequently, it is to achieve the effect of firmly securing the retaining member while allowing the retaining member to be removed for replacement or repair easily.

In another aspect, the present invention is to provide a pneumatic tool with a forward and reverse rotation control structure, capable of using a positioning pin to penetrate into a housing from the inner side to the outer side in order to allow a pin head or a rear end of the positioning pin to be retained by a power unit, thereby ensuring that the positioning pin is secured without slippage or disengagement.

In still another aspect, the present invention is to provide a pneumatic tool with a forward and reverse rotation control structure, capable of providing a relatively greater structural strength between a sliding block of a push button and a slot wall of a retaining member in order to prevent the occurrence of slipping off or snapping off of component parts.

Accordingly, the present invention provides a pneumatic tool with a forward and reverse rotation control structure, comprising: a housing having an installation space; a retaining member arranged inside the installation space and configured to divide the installation space into two push button accommodating cavities; two push buttons configured to movably slide inside the two push button accommodating cavities respectively, and the retaining member configured to restrict sliding ranges of the two push buttons; and a positioning pin penetrating into the housing, and the retaining member being secured by the housing and the positioning pin.

In comparison to the prior art, the present invention is able to achieve the following technical effects: It is able to firmly secure the retaining member while allowing the retaining member to be removed for replacement or repair easily; it is able to prevent any slippage or disengagement of the positioning pin; it is able to prevent the occurrence of slipping off or snapping off of component parts between the sliding block of the push button and the slot wall of the retaining member.

DETAILED DESCRIPTION OF THE INVENTION

The following provides a detailed technical content of the present invention along with the accompanied drawings. However, it shall be understood that the accompanied drawings are provided for reference and illustration purposes only such that they shall not be used to limit the scope of the present invention.

Figure 1:
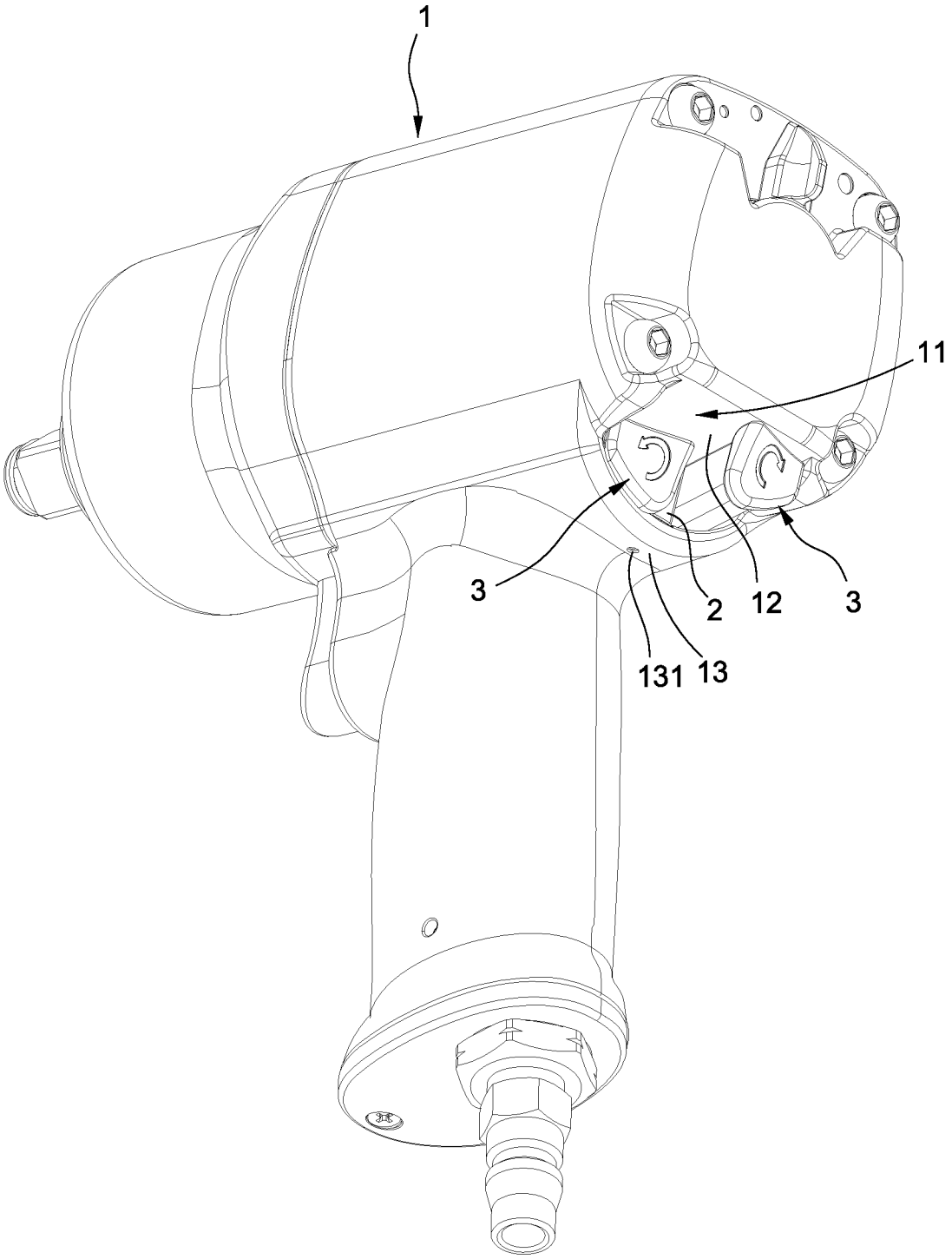
FIG. 1 is a perspective view of the first exemplary embodiment of the present invention as viewed from the rear.
Figure 2:
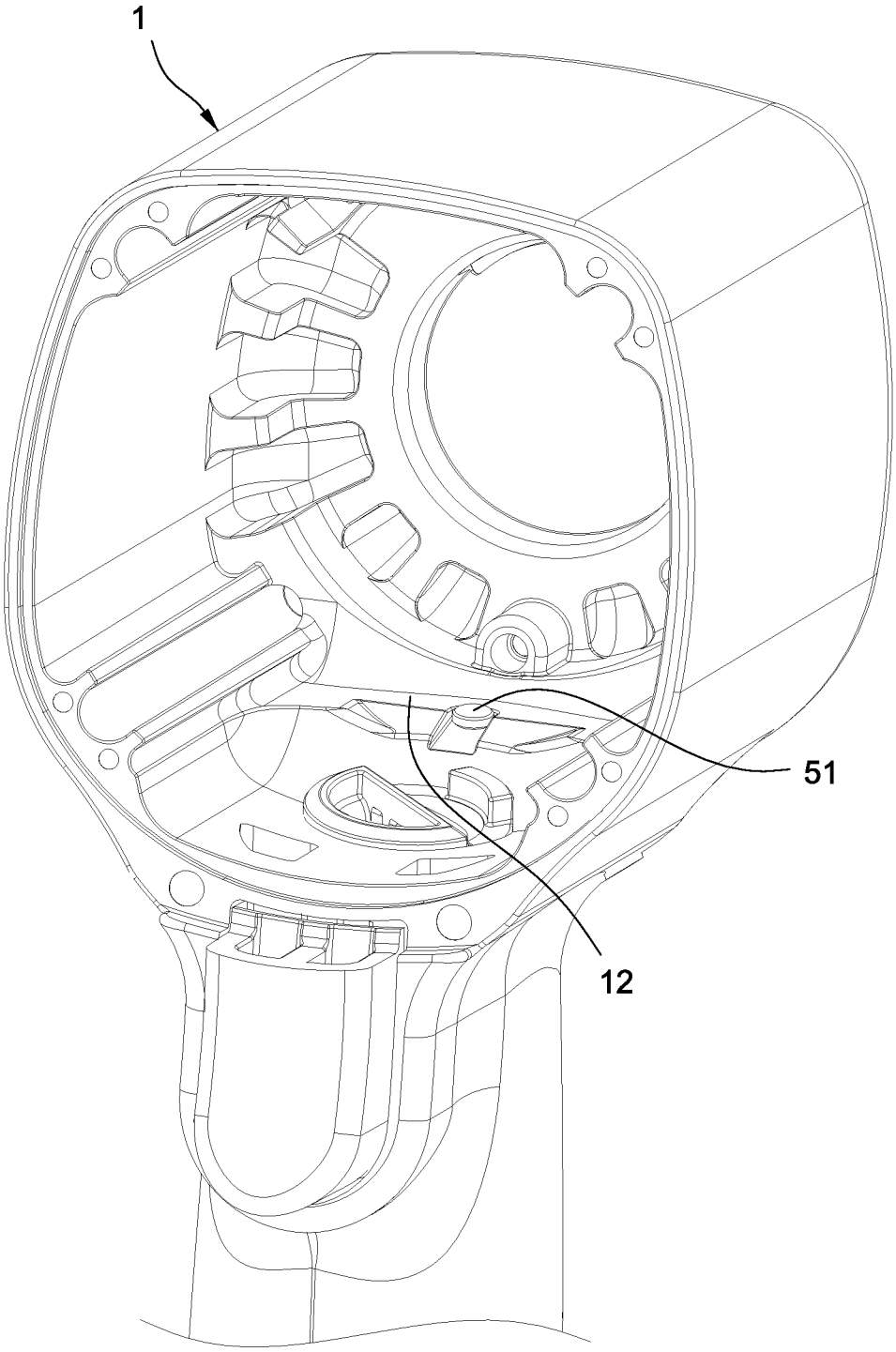
FIG. 2 is a perspective view of the housing in the first exemplary embodiment of the present invention as viewed from the front.
Figure 5:
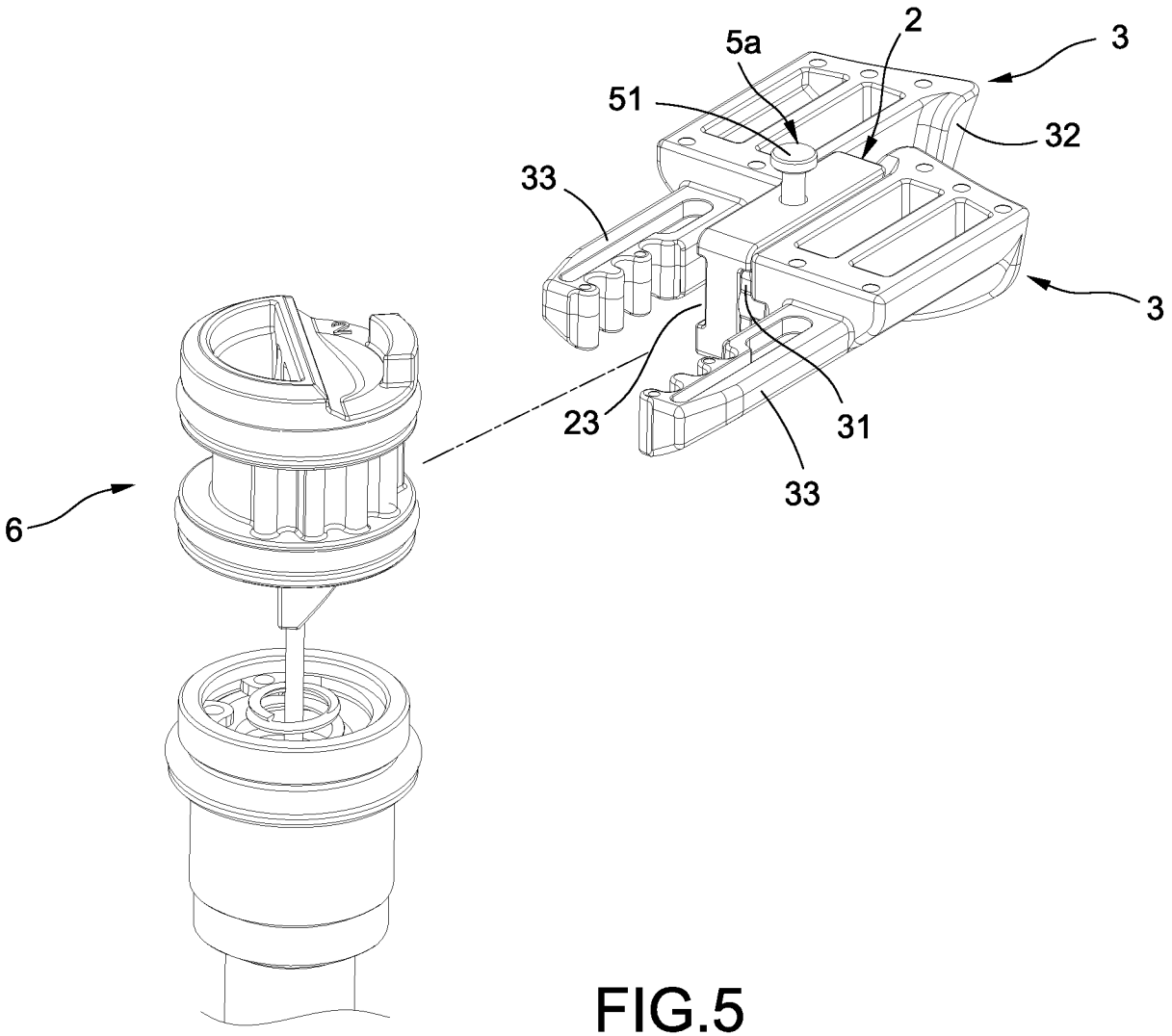
FIG. 5 is a perspective exploded view of the retaining member, push buttons and driven gear member in the first preferred embodiment of the present invention.

As shown in FIG. 1, the present invention provides a pneumatic tool with a forward and reverse rotation control structure. The forward and reverse rotation control structure (at least including the push buttons 3 for driving a driven gear member 6 to perform forward or reverse rotations as shown in FIG. 5) is used to control the forward rotation or reverse rotation of a power unit (not shown in the drawings) in the pneumatic tool.

As shown in FIG. 1 to FIG. 6, according to a first exemplary embodiment of the present invention of a pneumatic tool with a forward and reverse rotation control structure (referred to as the "pneumatic tool") comprises: a housing 1, a retaining member 2, two push buttons 3 and a positioning pin 5*a*, preferably further comprising two elastic positioning members 4.

Figure 6:
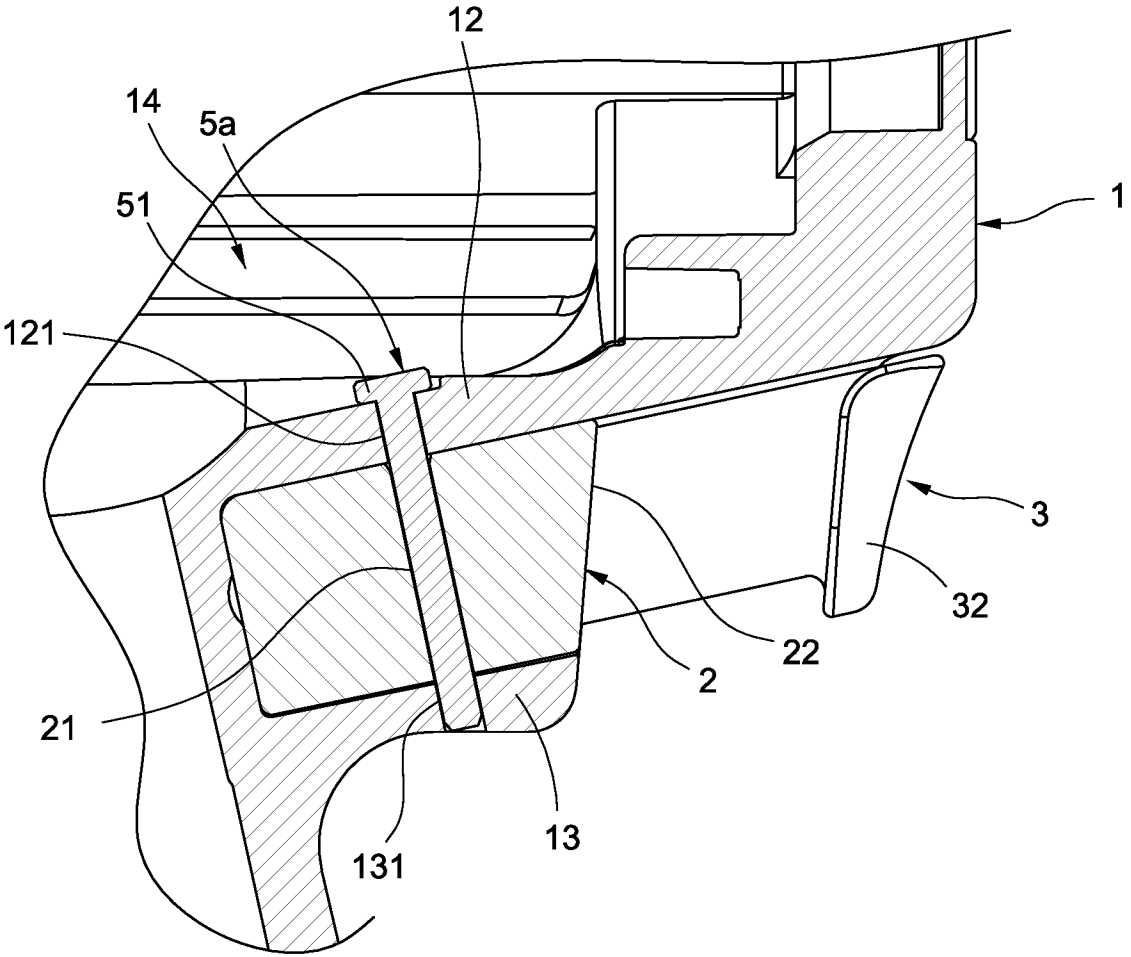
FIG. 6 is a cross sectional side view of the present invention according to FIG. 1.

The housing 1 includes an installation space 11 (as shown in FIG. 1) and a power unit positioning portion 14 (as shown in FIG. 6). To be more specific, the housing 1 further includes an inner housing plate 12 and an outer housing plate 13 arranged at two opposite portions of the installation space 11 respectively. In an exemplary embodiment, the outer housing plate 13 is positioned at a bottom side of the housing 1, and the inner housing plate 12 is positioned between the outer housing plate 13 at the bottom side and the outer housing plate (not indicated with a component sign) at the top side. Preferably, the inner housing plate 12 and the outer housing plate 13 include a first pin hole 121 and a second pin hole 131 formed thereon respectively.

The power unit positioning portion 14 is positioned inside the housing 1 and is used to position the power unit (not shown in the drawings) in order to allow the power unit to be detachably positioned at the power unit positioning portion 14. In an exemplary embodiment, the power unit is a power unit using pneumatic power, and such power unit includes the component parts of cylinder sets etc.

Figure 3:
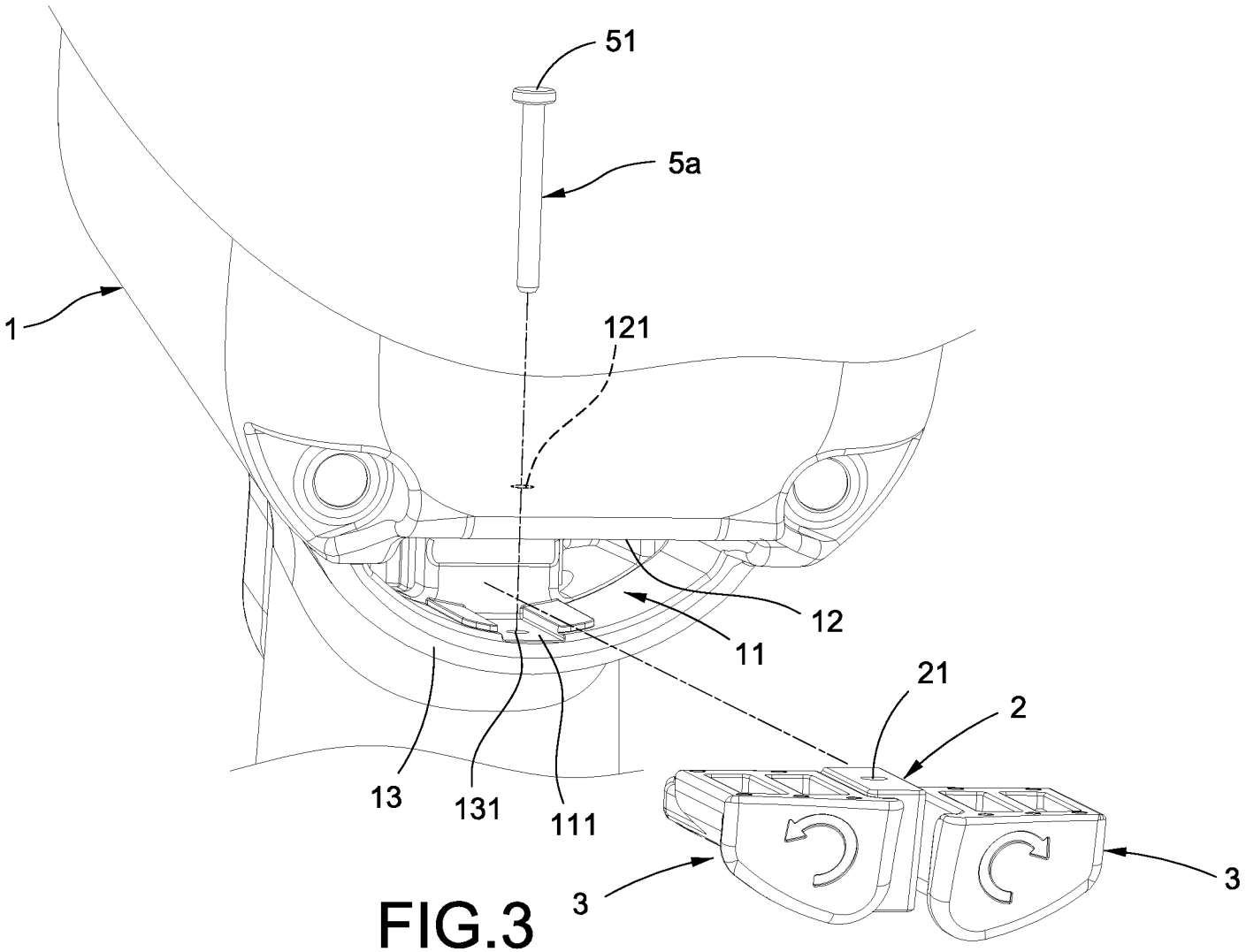
FIG. 3 is a perspective exploded view of the present invention according to FIG. 1.
Figure 4:
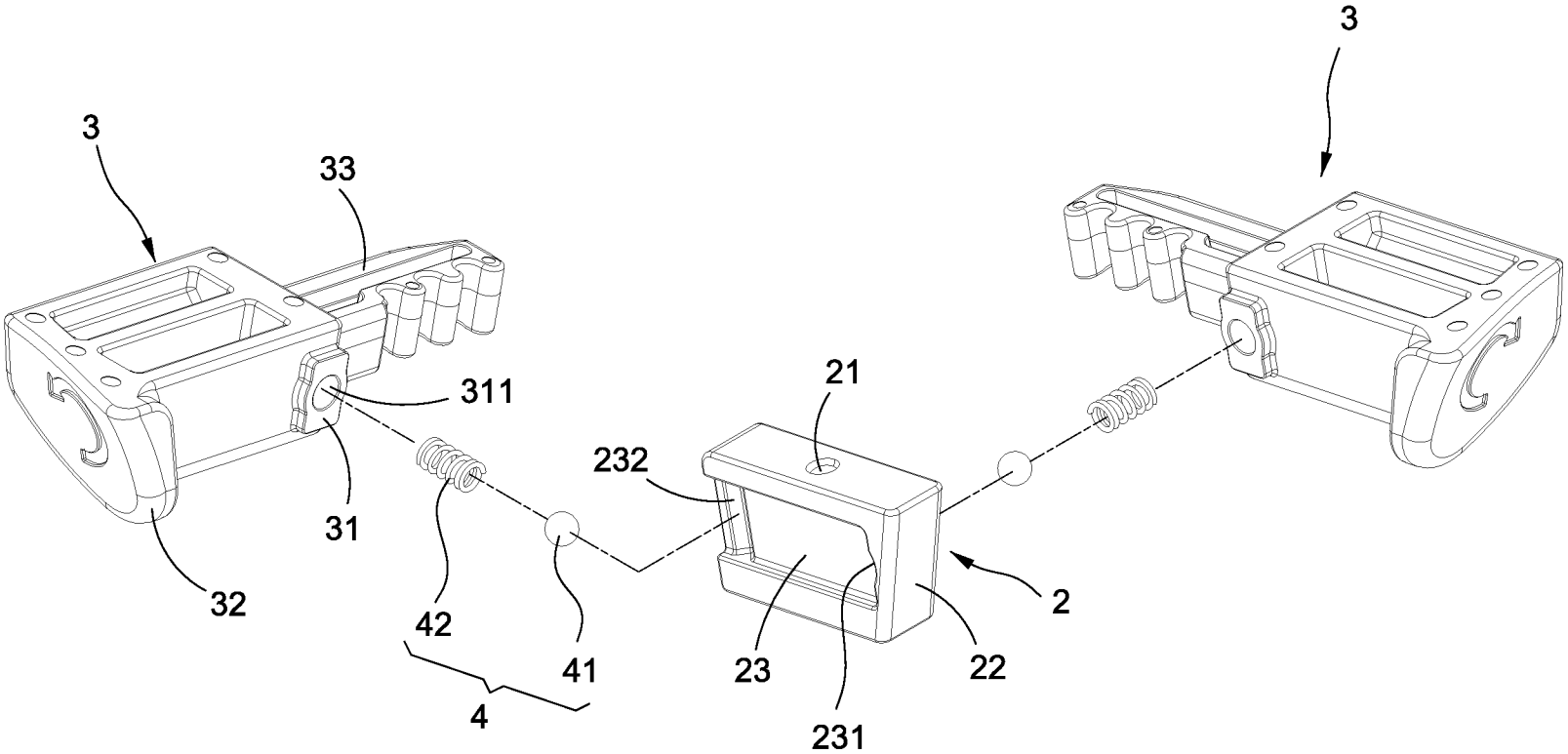
FIG. 4 is a perspective exploded view of the retaining member, push buttons and elastic positioning members of the present invention according to FIG. 3.

The retaining member 2 is arranged inside the installation space 11 to divide the installation space 11 into two push button accommodating cavities (not shown in the drawings). To be more specific, the top surface of the outer housing plate 13 includes a recess slot 111 (as shown in FIG. 3). The retaining member 2 is installed into the installation space 11 via the recess slot 111, as shown in FIG. 6, and the retaining member 2 is vertically bridged between the inner housing plate 12 and the outer housing plate 13. Preferably, the retaining member 2 includes a third pin hole 21 formed thereon, and the third pin hole 21 is positioned between the first pin hole 121 and the second pin hole 131 in order to be connected to each other.

The positioning pin 5*a* penetrates into the housing 1 and the retaining member 2, thereby allowing the retaining member 2 to be secured by the housing 1 and the positioning pin 5*a*. In other words, the retaining member 2 can be firmly secured between the housing 1 and the positioning pin 5*a*. In an exemplary embodiment, the positioning pin 5*a* detachably penetrates into the first pin hole 121, the second pin hole 131 and the third pin hole 21 in order to allow the retaining member 2 to be firmly secured while permitting removal for replacement or repair by removing the positioning pin 5*a*.

In addition, the penetrating direction of the positioning pin 5*a* can penetrate into the outer housing plate 13 from the inner housing plate 12 via the retaining member 2; in other words, it penetrates from the inner side to the outer side. The positioning pin 5*a* detachably penetrates into the second pin hole 131 from the first pin hole 121 via the third pin hole 21 of the retaining member 2 in order to allow the pin head 51 of the positioning pin 5*a* to be positioned between the power unit and the inner housing plate 12. In other words, the pin head 51 only appears at the top surface of the inner housing plate 12. Accordingly, at the outer appearance, the second pin hole 131 is only visible on the housing 1 as shown in FIG. 1 such that it is able to achieve the effect of concealing the positioning pin 5*a* and the preferred appearance visual effect of preventing the exposure of the pin head 51. In addition, by retaining the power unit at the pin head, it is able to ensure that the positioning pin 5*a* is not retracted in a reverse direction. Moreover, to perform replacement or repair, the user can simply remove the power unit form the power unit positioning unit 14 in order to remove the positioning pin 5*a* in a reverse direction, followed by removing the retaining member 2.

The two push buttons 3 are configured to movably slide inside the two push button accommodating cavities, and the retaining member 2 can be used to restrict the sliding ranges of the two push buttons 3. To be more specific, the push button 3 includes a gear rack 33, and the gear rack 33 of each push button 3 engages with the corresponding portion of a driven gear member 6 in order to drive the driven gear member 6 to perform forward and reverse rotations respectively, thereby controlling the forward and reverse rotations of the pneumatic tool of the present invention. Furthermore, the driven gear member 6 is also installed inside the housing 1.

As shown in FIG. 4 to FIG. 6 and FIG. 9, two walls of the retaining member 2 further include a sliding slot 23 formed thereon respectively, and the sliding slot 23 is of an open front end. The retaining member 2 includes a slot wall 231 formed at a rear end corresponding to each one of the sliding slots 23. The slot wall 231 blocks a sliding direction of the push button 3. To be more specific, one end of the retaining member 2 includes a retaining end 22 formed thereon, and the retaining end 22 is exposed at the installation space 11 in order to block another sliding direction of the push button 3. Preferably, the front end of the retaining member 2 corresponding to each one of the sliding slots 23 further includes a positioning portion 232 formed thereon, and the slot wall 231 and the positioning portion 232 are spaced apart from each other. As long as the positioning portion 232 is able to achieve the positioning effect, it is not limited to any type of structures, and in an exemplary embodiment, the positioning portion 232 is embodied as a slot for illustration purpose.

The push button 3 includes a sliding block 31 and a retaining block 32 protruded thereon and arranged spaced apart from each other. Each push button 3 is engaged with the two walls of the retaining member 2 in order to allow the push button 3 to slide inside the sliding slot 23 with the sliding block 31. The slot wall 231 blocks on a path of the sliding block 31 sliding toward a rear direction. In addition, the retaining end 22 of the retaining member 2 blocks a path of each one of the retaining blocks 32 sliding toward a front direction.

The elastic positioning member 4 is arranged between the sliding block 31 and the sliding slot 23. The push button 3 drives the elastic positioning member 4 to slide together in order to be positioned corresponding to the positioning portion 232, thereby allowing the push button 3 to be equipped with the effect of sliding positioning. To be more specific, the elastic positioning member 4 comprises a positioning ball 41 and an elastic element 42. The sliding block 31 includes a receiving hole 311 formed thereon. The elastic element 42 is elastically supported between the positioning ball 41 and the receiving hole 311, and the positioning ball 41 protrudes out of the receiving hole 311. Accordingly, the positioning ball 41 can be locked into the positioning portion 232 correspondingly for positioning. Furthermore, as the positioning ball 41 collides with the retaining member, 2 a sound can be generated upon the completion of the positioning.

Figure 9:
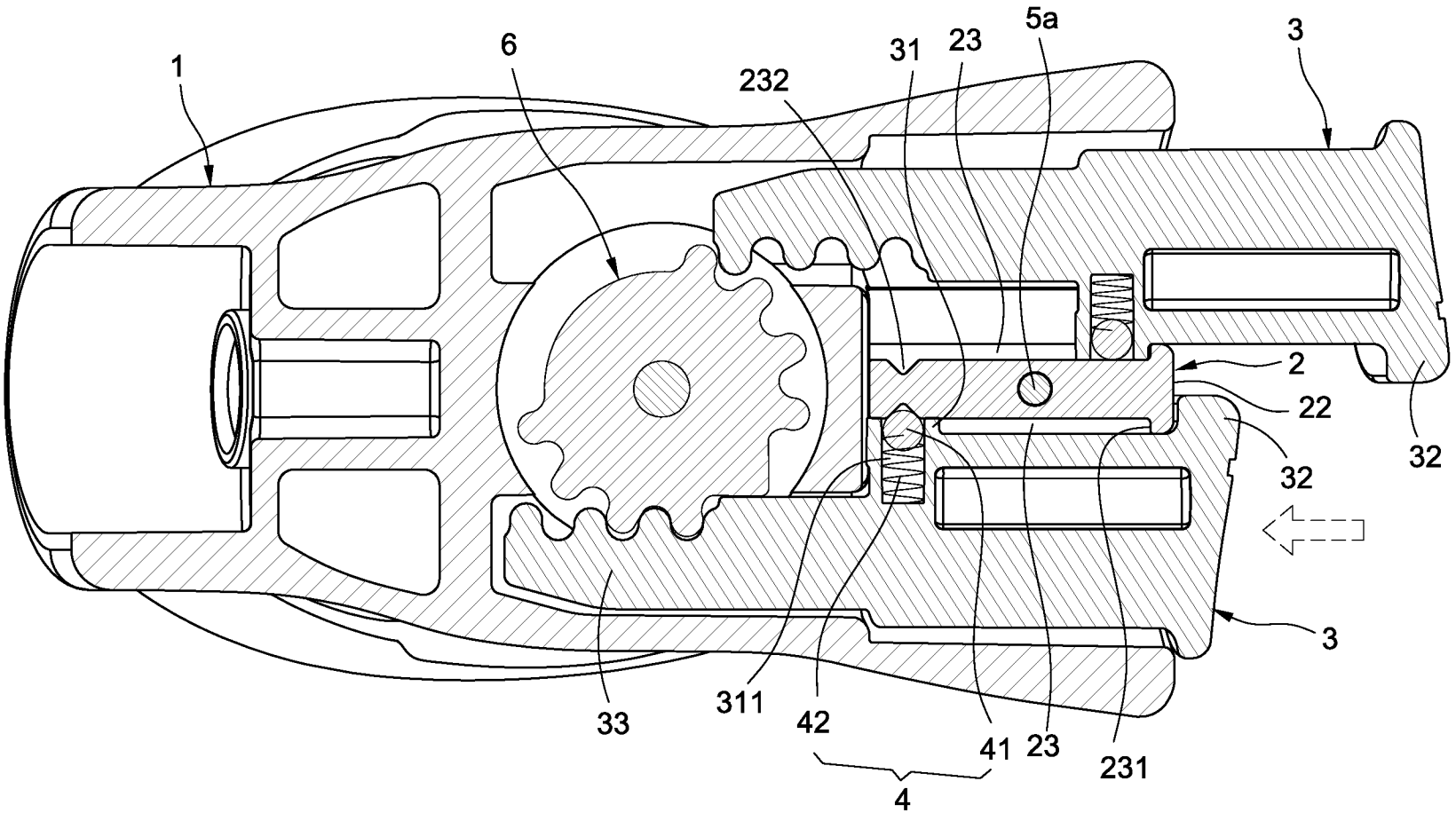
FIG. 9 is a cross sectional side view of the first and second exemplary embodiments showing the state when a push button is pressed.
Figure 10:
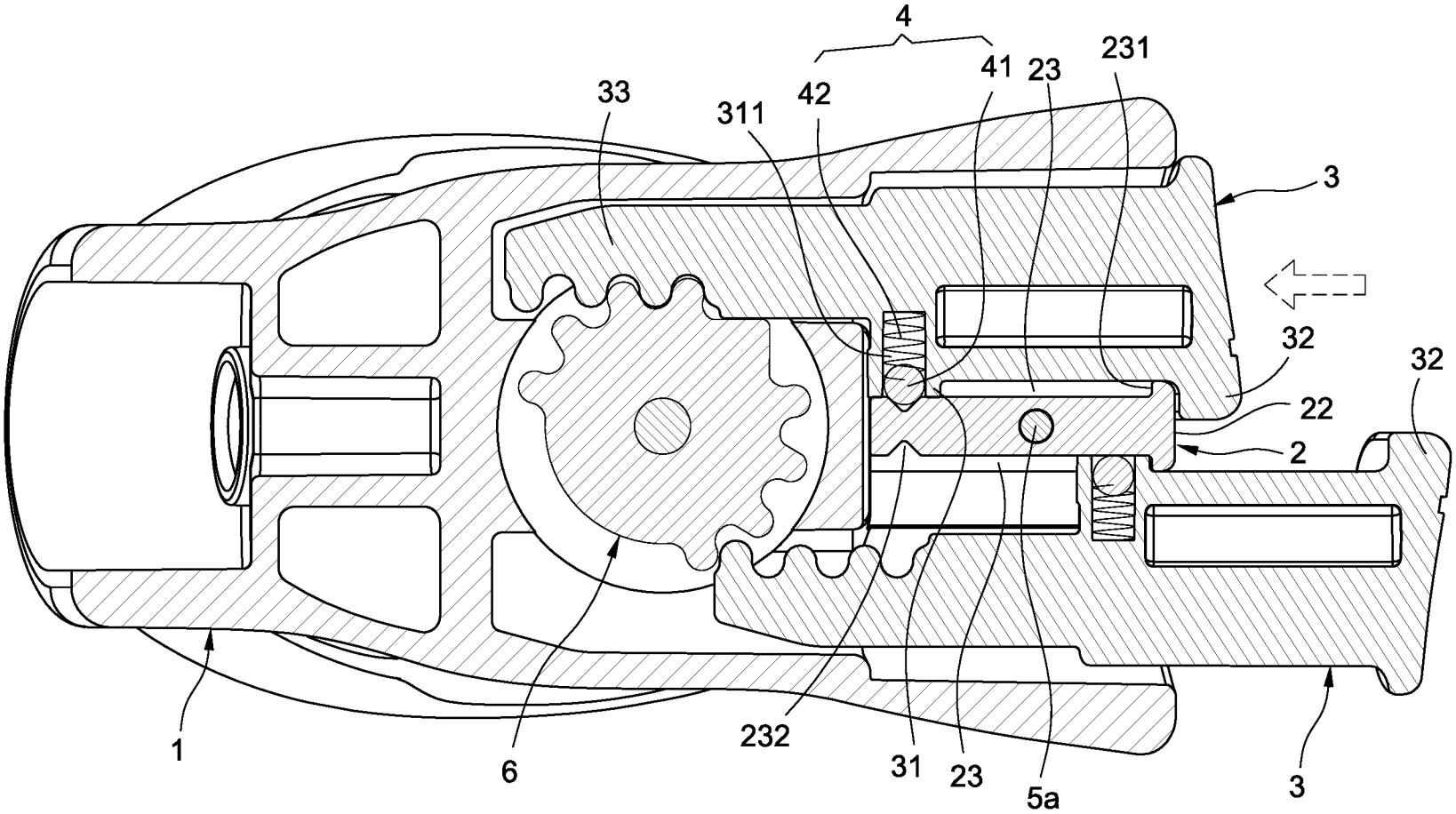
FIG. 10 is a cross sectional side view of the first and second exemplary embodiments showing the state when the other push button is pressed.

Accordingly, as shown in FIG. 9 and FIG. 10, the user is able to press the two push buttons 3 respectively in order to allow the two push buttons 3 to slide inside the two push button accommodating cavities. When the push button 3 slides toward the front, the retaining end 22 is able retain the retaining block 32 of the push button 3. When the push button 3 slides toward the rear, the slot wall 231 is able to retain the sliding block 31 of the push button 31. Consequently, the front and rear sliding ranges of the push button 3 is restricted. It shall be noted that since the push button 3 is retained as the sliding block 31 with a protruding shape being retained by the slot wall 231 also with a protruding shape, a preferred structural strength can be obtained between the sliding block 31 and the slot wall 231, thereby preventing the occurrence of slipping off or snapping off of component parts.

Figure 7:
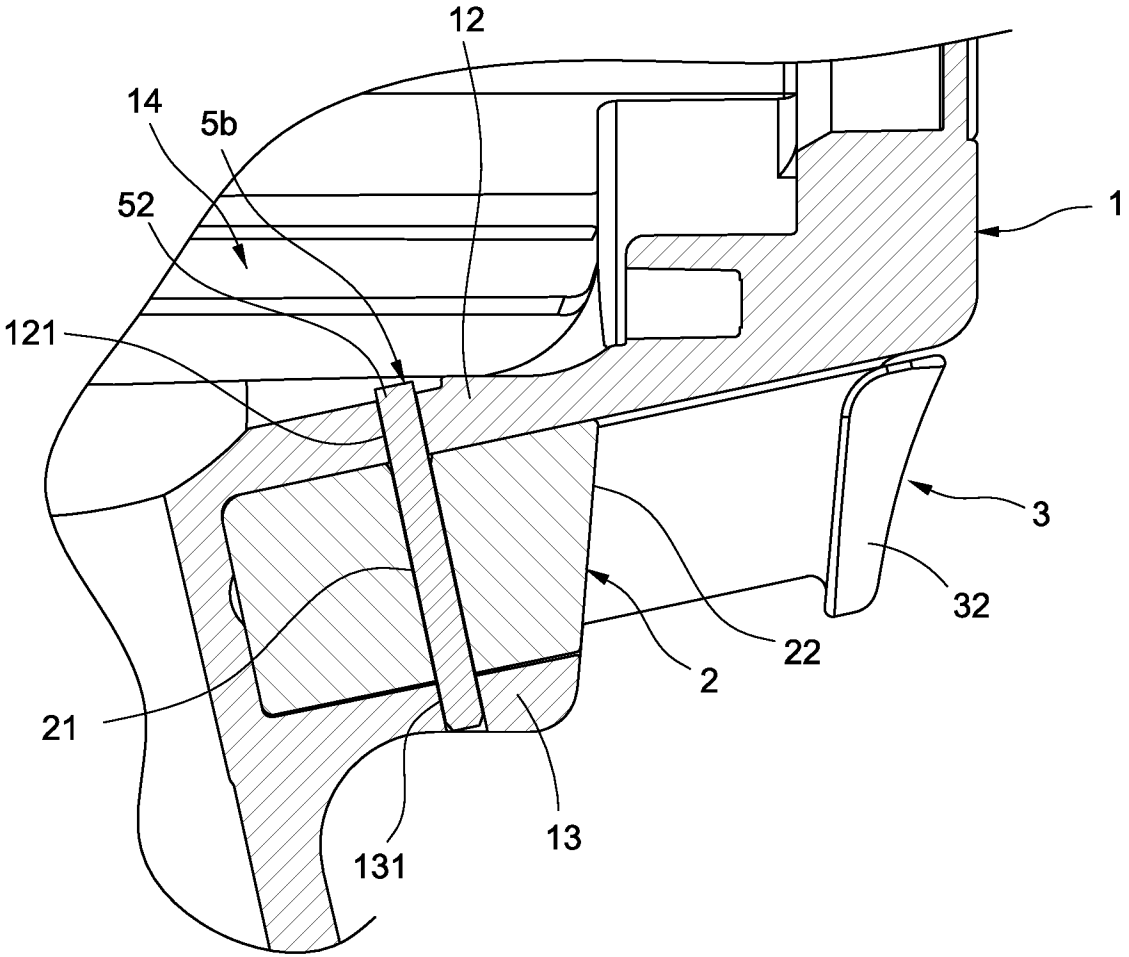
FIG. 7 is a cross sectional side view of the second exemplary embodiment of the present invention.

FIG. 7 shows a second exemplary embodiment of the present invention, and the second exemplary embodiment is generally identical to the first exemplary embodiment. The difference mainly relies in the structure of the positioning pin 5*b* in the second exemplary embodiment different from the structure of the positioning pin 5*a* in the first exemplary embodiment.

As shown in the drawing, the positioning pin 5*b* does not include the pin head 51 shown in the first exemplary embodiment, and the positioning pin 5*b* in the second exemplary embodiment is an insertion pin with a rear end 52. The rear end 52 is also positioned between the power unit and the inner housing plate 12 such that the power unit also retains the rear end 52, thereby achieving the effect described in the first exemplary embodiment.

Figure 8:
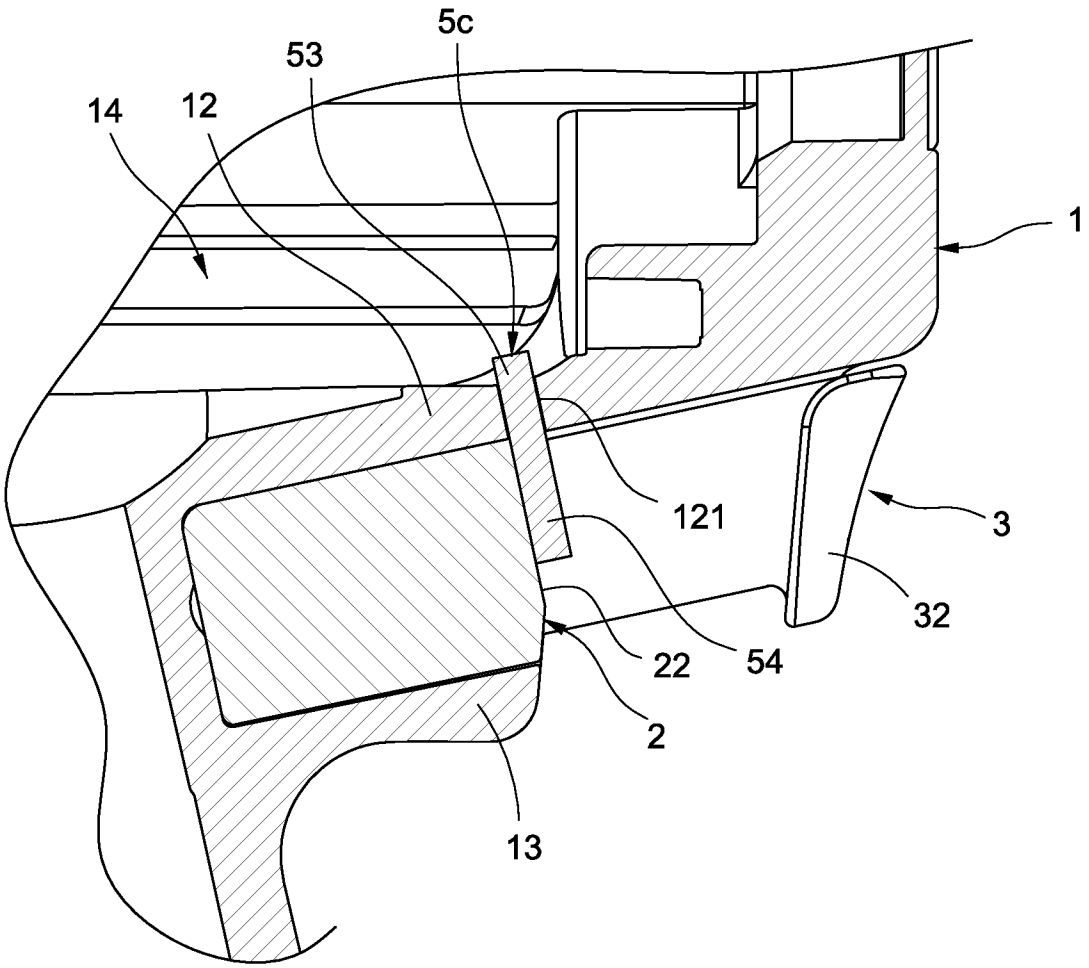
FIG. 8 is a cross sectional side view of the third exemplary embodiment of the present invention.

FIG. 8 shows a third exemplary embodiment of the present invention, and the third exemplary embodiment is generally identical to the second exemplary embodiment. The difference mainly relies in the structure of the positioning pin 5*c* in the third exemplary embodiment different from the structure of the positioning pin 5*b* in the second exemplary embodiment, and the positioning pin 5*c* penetrates into the housing 1 only; meaning that it does not penetrate into the retaining member 2. However, the positioning pin 5*c* is able to retain the retaining member 2 in order to allow the retaining member 2 to be secured by the housing 1 and the positioning pin 5*c*.

As shown in the drawing, the positioning pin 5C is a simple insertion pin with a rear end 53 and a retaining section 54. The retaining section 54 protrudes between the inner housing plate 12 and the outer housing plate 13. The rear end 53 is also positioned between the power unit and the inner housing plate 12 in order to allow the power unit to retain the rear end 53. The retaining section 54 is retained at the retaining end 22 of the retaining member 2 in order to allow the retaining member 2 to be secured between the housing 1 and the positioning pin 5*c*. Consequently, it is able to achieve the effect described in the first exemplary embodiment.

In view of the above, the pneumatic tool with a forward and reverse rotation control structure of the present invention is able to achieve the expected objectives of use and to overcome the drawbacks of the prior arts. Therefore, the present invention is of novelty and inventive step, complying with the patentability for an invention patent. Accordingly, patent application is hereby filed according to the law in light of the grant of the patent right for the protection of the rights of the inventor.

The above describes the preferable and feasible exemplary embodiments of the present invention for illustrative purposes only, which shall not be treated as limitations of the scope of the present invention. Any equivalent changes and modifications made in accordance with the scope of the claims of the present invention shall be considered to be within the scope of the claim of the present invention.

What is claimed is:

1. A pneumatic tool with a forward and reverse rotation control structure, comprising:

a housing having an installation space;

a retaining member arranged inside the installation space and configured to divide the installation space into two push button accommodating cavities;

two push buttons configured to movably slide inside the two push button accommodating cavities respectively, and the retaining member being configured to restrict sliding ranges of the two push buttons;

a positioning pin penetrating into the housing, and the retaining member being secured by the housing and the positioning pin; and a driven gear member installed inside the housing for switching a forward and a reverse rotation, wherein the respective push buttons engage with the driven gear member so as to rotate the driven gear member to perform the forward rotation or the reverse rotation when the respective corresponding push buttons slide, wherein two walls of the retaining member include a sliding slot formed thereon respectively, and the retaining member includes a slot wall formed corresponding to each one of the sliding slots; each one of the push buttons includes a sliding block protruded thereon; each one of the push buttons slides inside each one of the sliding slots with the sliding block; the slot wall of each one of the sliding slots blocks a path of each one of the sliding blocks sliding toward a first direction.

2. The pneumatic tool with a forward and reverse rotation control structure according to claim 1, wherein the positioning pin further penetrates into the retaining member; the housing includes an inner housing plate and an outer housing plate arranged at two opposition portions of the installation space respectively; the positioning pin penetrates into the outer housing plate from the inner housing plate via the retaining member.

3. The pneumatic tool with a forward and reverse rotation control structure according to claim 2, wherein the inner housing plate and the outer housing plate include a first pin hole and a second pin hole formed thereon respectively; the retaining member includes a third pin hole formed thereon; the third pin hole is positioned between the first pin hole and the second pin hole in order to be connected to each other; the positioning pin detachably penetrates into the second pin hole from the first pin hole via the third pin hole.

4. The pneumatic tool with a forward and reverse rotation control structure according to claim 2, further comprising a power unit, wherein the power unit is detachably arranged inside the housing; the positioning pin includes a pin head; the pin head is positioned between the power unit and the inner housing plate; the power unit retains the pin head.

5. The pneumatic tool with a forward and reverse rotation control structure according to claim 2, further comprising a power unit, wherein the power unit is detachably arranged inside the housing; the positioning pin includes a rear end, and the rear end is positioned between the power unit and the inner housing plate; the power unit retains the rear end, sliding toward a second direction opposite from the first direction.

6. The pneumatic tool with a forward and reverse rotation control structure according to claim 1, wherein the positioning pin penetrates into the housing only, and the positioning pin further retains the retaining member; the retaining member is secured by the housing and the positioning pin.

7. The pneumatic tool with a forward and reverse rotation control structure according to claim 6, wherein the positioning pin is retained at a retaining end of the retaining member; the housing includes an inner housing plate and an outer housing plate arranged at two opposite portions of the installation space respectively; the positioning pin penetrates into the inner housing plate in a direction from the inner housing plate toward the outer housing plate.

8. The pneumatic tool with a forward and reverse rotation control structure according to claim 7, further comprising a power unit, wherein the power unit is detachably arranged inside the housing; the positioning pin includes a rear end and retaining section; the retaining section is positioned between the inner housing plate and the outer housing plate and is retained at the retaining end; the rear end is positioned between the power unit and the inner housing plate; the power unit retains the rear end.

9. The pneumatic tool with a forward and reverse rotation control structure according to claim 1, wherein each one of the push buttons further includes a retaining block protruded thereon; the sliding block and the retaining block are arranged spaced apart from each other; the retaining member includes a retaining end; the retaining end of the retaining member blocks a path of each one of the retaining block members, wherein each one of the positioning members is arranged between each one of the sliding blocks and each one of the sliding slots; the retaining member includes a positioning portion formed corresponding to each one of the sliding slots; each one of the push buttons drives each one of the elastic positioning members to slide together in order to be positioned corresponding to each one of the positioning portions.

10. The pneumatic tool with a forward and reverse rotation control structure according to claim 1, further comprising two elastic positioning members, wherein each one of the positioning members is arranged between each one of the sliding blocks and each one of the sliding slots; the retaining member includes a positioning portion formed corresponding to each one of the sliding slots; each one of the push buttons drives each one of the elastic positioning members to slide together in order to be positioned corresponding to each one of the positioning portions.

11. The pneumatic tool with a forward and reverse rotation control structure according to claim 10, wherein each one of the elastic positioning members comprises a positioning ball and an elastic element; the elastic element is supported between the positioning ball and the sliding block; each one of the positioning balls is locked into each one of the positioning portions correspondingly for positioning.

12. The pneumatic tool with a forward and reverse rotation control structure according to claim 6, wherein each one of the push buttons further includes a retaining block protruded thereon; the sliding block and the retaining block are arranged spaced apart from each other; the retaining member includes a retaining end; the retaining end of the retaining member blocks a path of each one of the retaining block sliding toward a second direction opposite from the first direction.

13. The pneumatic tool with a forward and reverse rotation control structure according to claim 6, further comprising two elastic positioning members, wherein each one of the positioning members is arranged between each one of the sliding blocks and each one of the sliding slots; the retaining member includes a positioning portion formed corresponding to each one of the sliding slots; each one of the push buttons drives each one of the elastic positioning members to slide together in order to be positioned corresponding to each one of the positioning portions.

14. The pneumatic tool with a forward and reverse rotation control structure according to claim 13, wherein each one of the elastic positioning members comprises a positioning ball and an elastic element; the elastic element is supported between the positioning ball and the sliding block; each one of the positioning balls is locked into each one of the positioning portions correspondingly for positioning.

* * * * *